US005637039A

United States Patent [19]

Chiu et al.

[11] Patent Number: 5,637,039

[45] Date of Patent: Jun. 10, 1997

[54] COMPACT PORTABLE WINDOW FAN

[75] Inventors: Bernard Chiu, Wellesley, Mass.; Jui-Shang Wang, Taipei, Taiwan; John Longan, Natick, Mass.; Robert L. Marvin, Jr., Farmington, Conn.

[73] Assignee: Duracraft Corporation, Southborough, Mass.

[21] Appl. No.: 398,229

[22] Filed: Mar. 3, 1995

[51] Int. Cl.[6] ..... F24F 7/013

[52] U.S. Cl. ..... 454/200; 248/188.2; 248/208

[58] Field of Search ..... 454/200, 201, 454/203, 204, 207; 62/262; 248/188.2, 208, 236, 649, 677

[56] References Cited

U.S. PATENT DOCUMENTS

| | | | |
|---|---|---|---|
| 2,296,635 | 9/1942 | Foehrenbach et al. | 454/207 X |
| 2,467,297 | 4/1949 | Doe | 454/200 |
| 2,583,555 | 1/1952 | Fields et al. | 454/207 |
| 2,674,430 | 4/1954 | Galazzi et al. | 248/208 X |
| 3,118,364 | 1/1964 | Sinclair | 454/200 |
| 4,899,645 | 2/1990 | Wolfe et al. | 454/200 X |
| 5,329,784 | 7/1994 | Kennedy et al. | 454/204 X |

FOREIGN PATENT DOCUMENTS

| | | | |
|---|---|---|---|
| 106646 | 7/1956 | Australia | 454/200 |

*Primary Examiner*—Harold Joyce
*Attorney, Agent, or Firm*—John E. Toupal; Harold G. Jarcho

[57] ABSTRACT

A portable fan including an air director housing for mounting between a sill and sash of an open window and having oppositely directed first and second open ends, spaced apart top and bottom walls extending between the first and second open ends, and spaced apart side walls joined to the top and bottom walls and extending between the first and second open ends; the side, top and bottom walls defining an air flow passage between said first and second open ends. Also included is a blower housing joined to the first open end of the air director housing and defining first and second openings for accommodating air flow; the blower housing projecting from the air director housing for a substantial first horizontally directed distance d and for a substantial second vertically directed distance D. A motor driven blower is retained in the blower housing and produces air flow between the first and second openings through the air flow passage.

14 Claims, 7 Drawing Sheets

COMPACT PORTABLE WINDOW FAN

BACKGROUND OF THE INVENTION

This invention relates generally to a portable electric fan and, more particularly, to a portable electric window fan.

Portable electric fans are used extensively to reduce personal discomfort caused by excessive temperatures. Some portable electric fans are designed specifically for mounting in open windows of inhabited enclosures and typically operable to either exhaust air from the enclosure or direct outside air thereinto. Although generally quite efficient in establishing desirable air circulation between inside and outside of a particular enclosure, prior window fans have had the disadvantages of protruding excessively into the enclosure and significantly reducing the value of a window in which the fan is mounted by significantly limiting both the level of light admitted and the view provided by the window.

The object of this invention, therefore, is to provide an improved, less conspicuous window fan.

SUMMARY OF THE INVENTION

The invention is a portable fan including an air director housing for mounting between a sill and sash of an open window and having oppositely directed first and second open ends, spaced apart top and bottom walls extending between the first and second open ends, and spaced apart side walls joined to the top and bottom walls and extending between the first and second open ends; the side, top and bottom walls defining an air flow passage between said first and second open ends. Also included is a blower housing joined to the first open end of the air director housing and defining first and second openings for accommodating air flow; the blower housing projecting from the air director housing for a substantial first horizontally directed distance d and for a substantial second vertically directed distance D. A motor driven blower is retained in the blower housing and produces air flow between the first and second openings through the air flow passage. The provision of a blower housing with substantial vertically and horizontally projecting portions accommodates a highly compact and inconspicuous fan that minimizes reduction in light transmission and visibility through a glass portion of the open window.

According to one feature of the invention, the air director housing is horizontally elongated with a length e at least five times its height h and the air flow passage has a given length s less than either the first distance d or the second distance D. Compactness of the fan is optimized by this feature.

According to another feature of the invention, the second distance is directed vertically upwardly from the air director housing. This feature permits mounting of the fan above a frame portion of the open window.

According to other features of the invention, the blower housing is substantially cylindrical, the blower includes a pair of squirrel cage blower wheels spaced apart on a horizontal axis, and a drive motor is straddled by the blower wheels and operatively coupled thereto. Miniaturization of the blower housing is facilitated by this arrangement.

According to yet other features of the invention, the second opening is formed by a plurality of downwardly directed separate openings spaced apart along the horizontal axis and at least one of the separate openings is disposed adjacent to each end of each blower wheel. The strategically positioned downwardly directed openings inhibit the entrance of rain into the blower housing and enhance blower efficiency.

According to further features of the invention, the blower housing includes a substantially insect impermeable screen covering each of the separate openings, a central portion retaining the blower wheels and the motor and end portions removably attached to opposite ends thereof and each defining one of the separate openings. The removable end portions accommodate cleaning of the screens which prevent insect access in installations negating the functionality of an existing window screen.

According to an additional feature of the invention, the second open end of the air director housing defines a pair of spaced apart ports separated by an electric control panel and each aligned with a different one of the blower wheels. Fan compactness is further enhanced by this arrangement.

According to an additional feature, the invention includes a leg projecting downwardly from the blower housing a predetermined distance below the bottom wall of the air director housing. The leg facilitates stabilization of the fan by engaging a bottom frame portion of the window.

According to still other features of the invention, the leg is a curved strip having a first terminal portion for engaging the frame portion of the window and a second terminal portion fixed to an outer portion of the blower housing means facing away from the air director housing, and a connection mechanism allows relative movement between the blower housing and the second terminal portion to adjust the predetermined distance. These features facilitate stable mounting of the fan in the window frame.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 5:
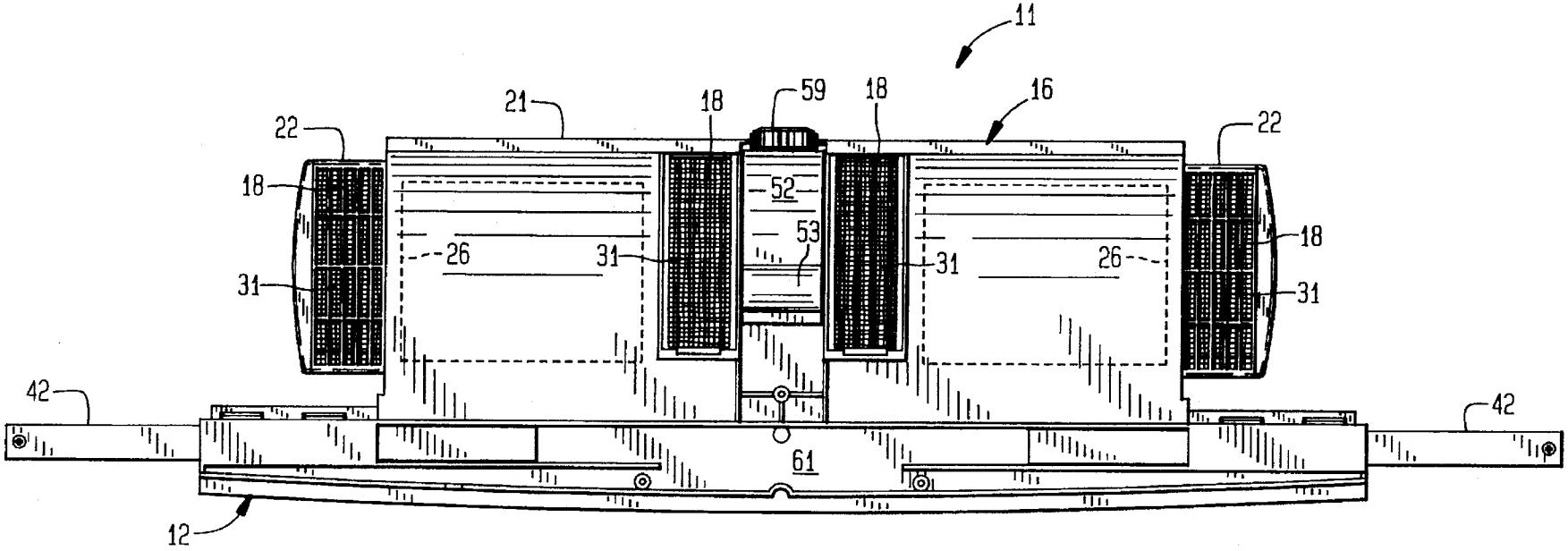
FIG. 5 is a bottom view of the fan shown in FIGS. 1–4.
Figure 6:
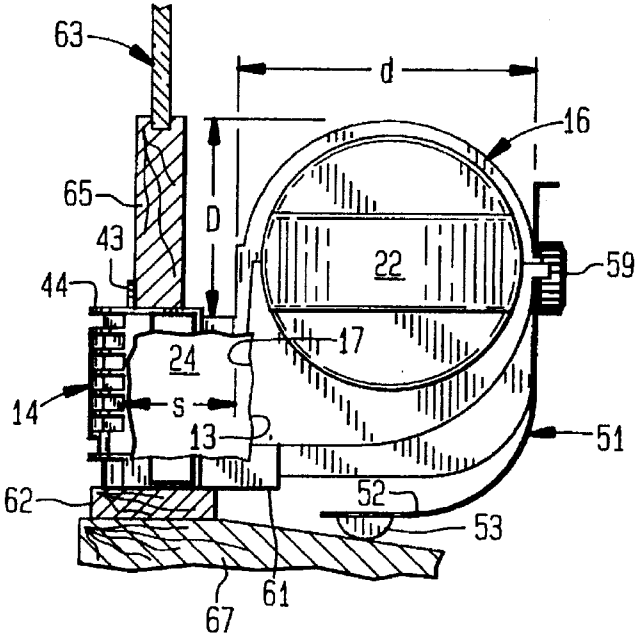
FIG. 6 is a partially cut-away right side elevational view of the fan shown in FIGS. 1–5.

A portable fan 11 includes a horizontally elongated, box shaped air director housing 12 having a first open end 13 and a second grill covered open end 14. Joined to the first open end 13 of the air director housing 12 and horizontally coextensive therewith is a blower housing 16 having a first horizontally elongated opening 17 communicating with the open first end 13 of the air director housing 12 as shown in FIG. 6. Also formed by the blower housing 16 are a plurality of downwardly directed grill covered second openings 18 illustrated clearly in FIG. 5. The air blower housing 16 has a generally cylindrical central portion straddled by hollow cylindrical end portions 22, each of which defines one of the second openings 18 and is removable.

As shown in FIG. 6, the air director housing 12 defines an air flow passage 24 of given length s extending between the first and second open ends 13, 14. The blower housing 16 projects from the air director housing 12 a substantial first horizontally directed distance d and a substantial second vertically directed distance D. Preferably, the air director housing 12 has a length l at five times its height h (FIG. 2) and the given length s of the air flow passage 24 is less than either of the first and second distances d, D as illustrated in FIG. 6.

Figure 8:
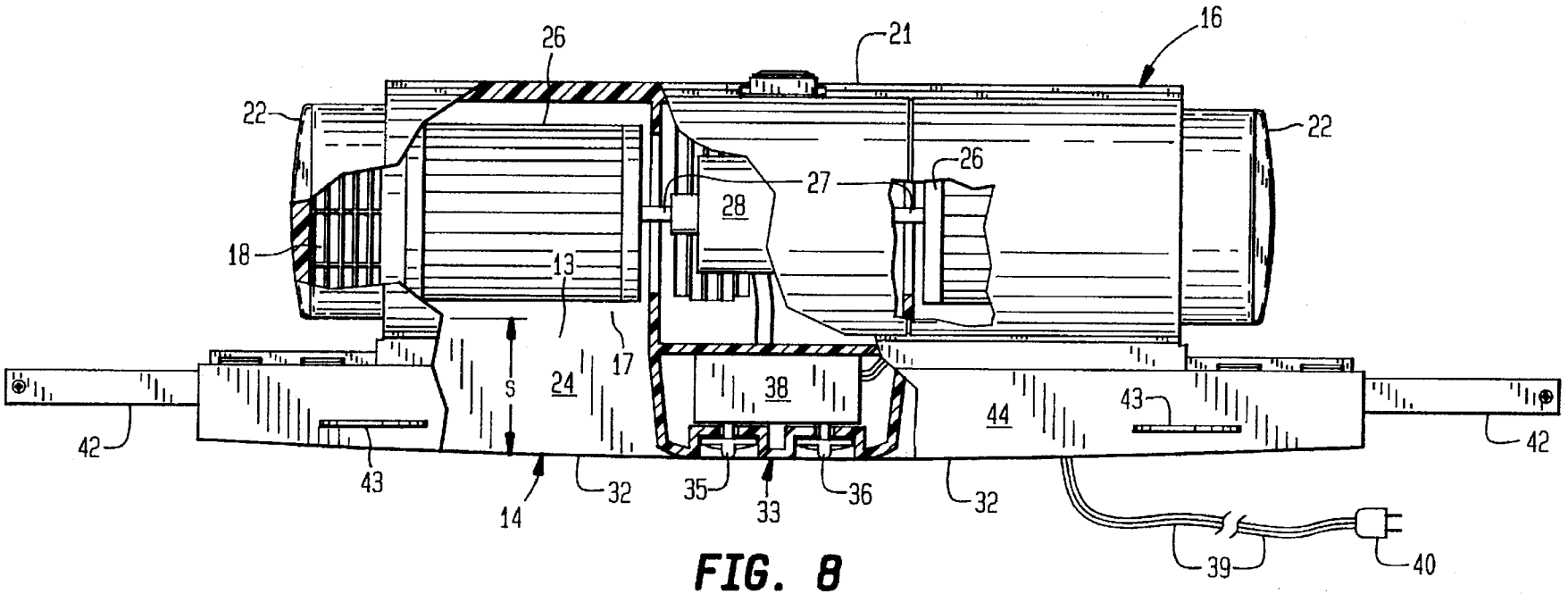
FIG. 8 is a partially cut-away top view of the fan shown in FIGS. 1–7.

The central portion 21 of the blower housing 16 retains a pair of squirrel cage blower wheels 26 spaced apart and aligned on a horizontal axis as depicted in FIG. 8. Straddled by the blower wheels 26 and operatively coupled thereto by drive shafts 27 is an electric motor 28 also retained by the central blower housing portion 21. The downwardly directed second openings 18 of the blower housing 16 are spaced apart along the horizontal axis of the blower wheels 26 and each opening 18 is covered by an insect impermeable screen 31. Each end of each of the blower wheels 26 is positioned transversely adjacent to one of the screen covered openings 18 as shown in FIG. 5.

Figure 1:
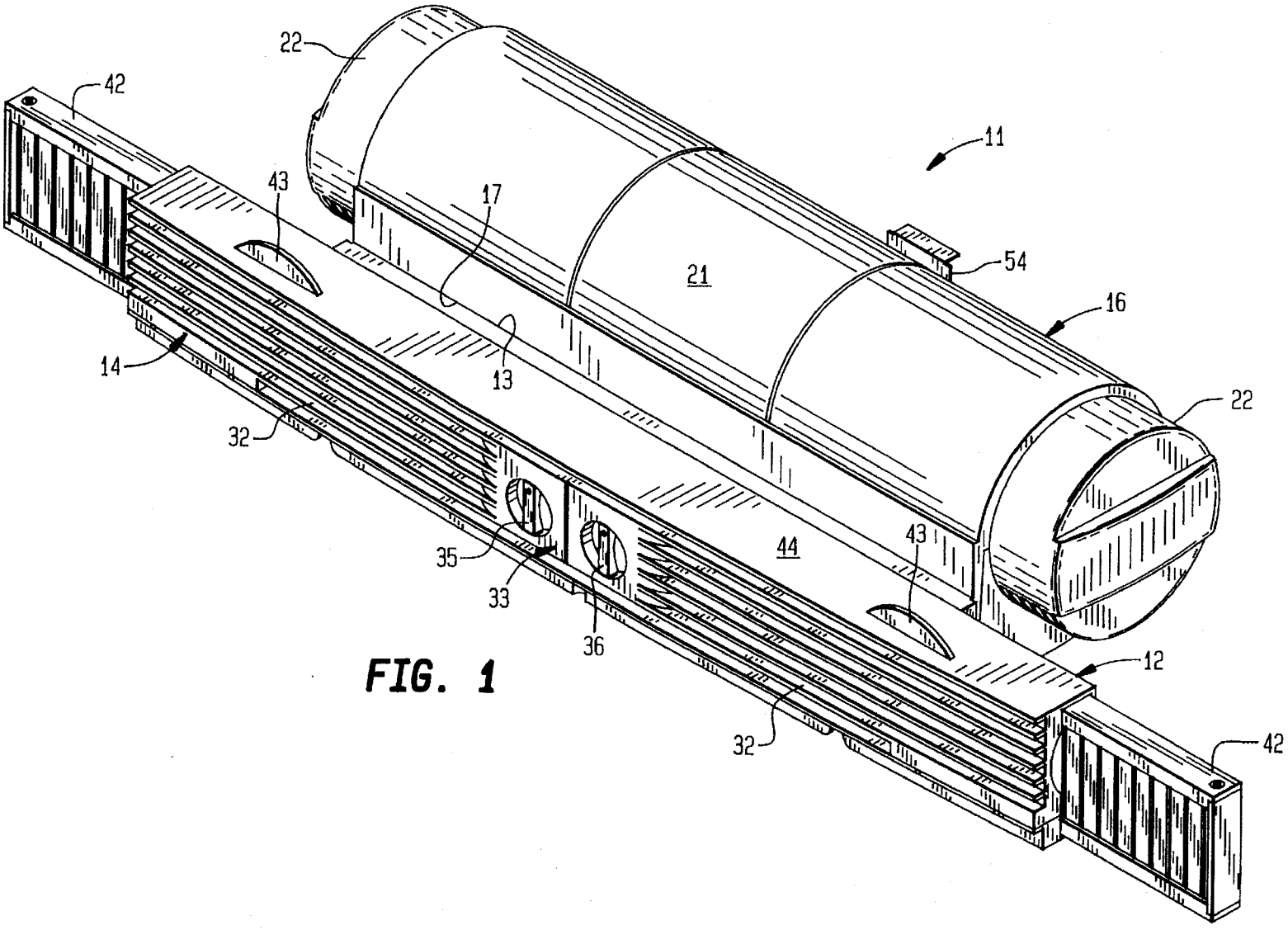
FIG. 1 is a front perspective view of a window fan according to the invention.
Figure 2:
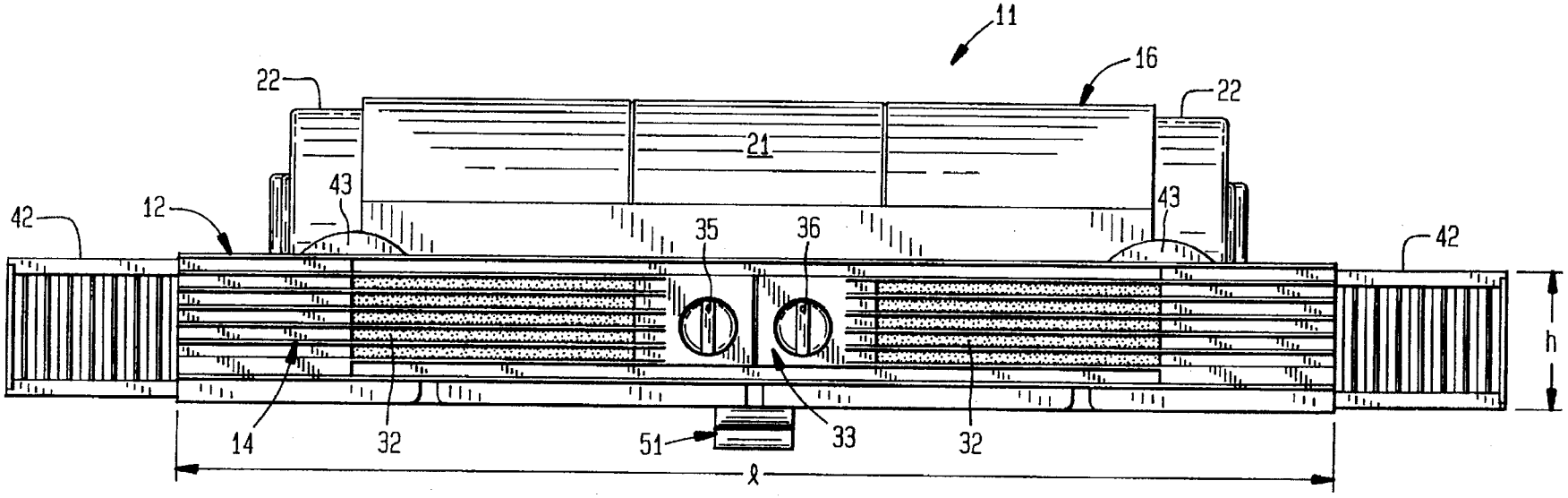
FIG. 2 is a front elevational view of the fan shown in FIG. 1.

The second open end 14 of the air director housing 12 is divided into a pair of grill covered ports 32 straddling a central control panel 33 illustrated in FIGS. 1 and 2. Retained by the control panel 33 are an on-off switch knob 35 and a thermostatic control knob 36. The switch knob 35 and control knob 36 are operatively coupled to circuitry retained by an electric control box 38 (FIG. 8) and connected to the electric motor 28 and a power cord 39 terminating with an electrical plug 40 for connection to a suitable power outlet (not shown). The control box is mounted in the air director housing 12 between the ports 32. Extendable from each oppositely directed lateral side wall 41 of the air director housing 12 is a louvered wing wall 42 of the type disclosed in U.S. Pat. No. 5,382,136. A pair of horizontally spaced apart tabs 43 extend upwardly from an upper surface 44 of the air director housing 12.

Figure 3:
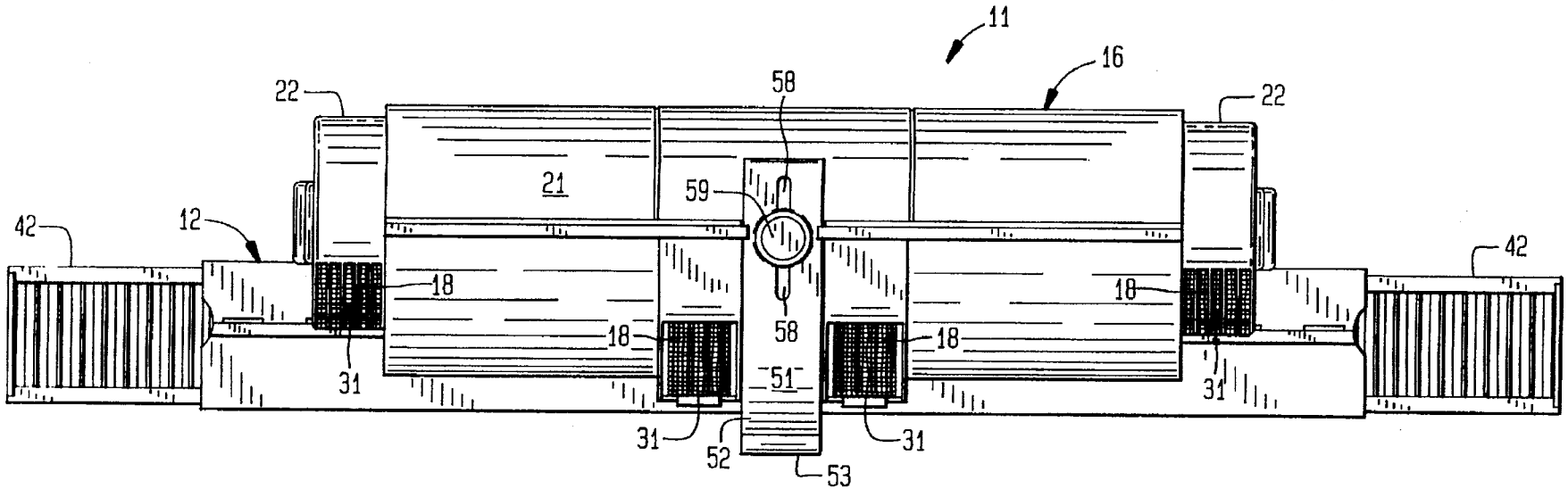
FIG. 3 is a rear elevational view of the fan shown in FIGS. 1 and 2.
Figure 4:
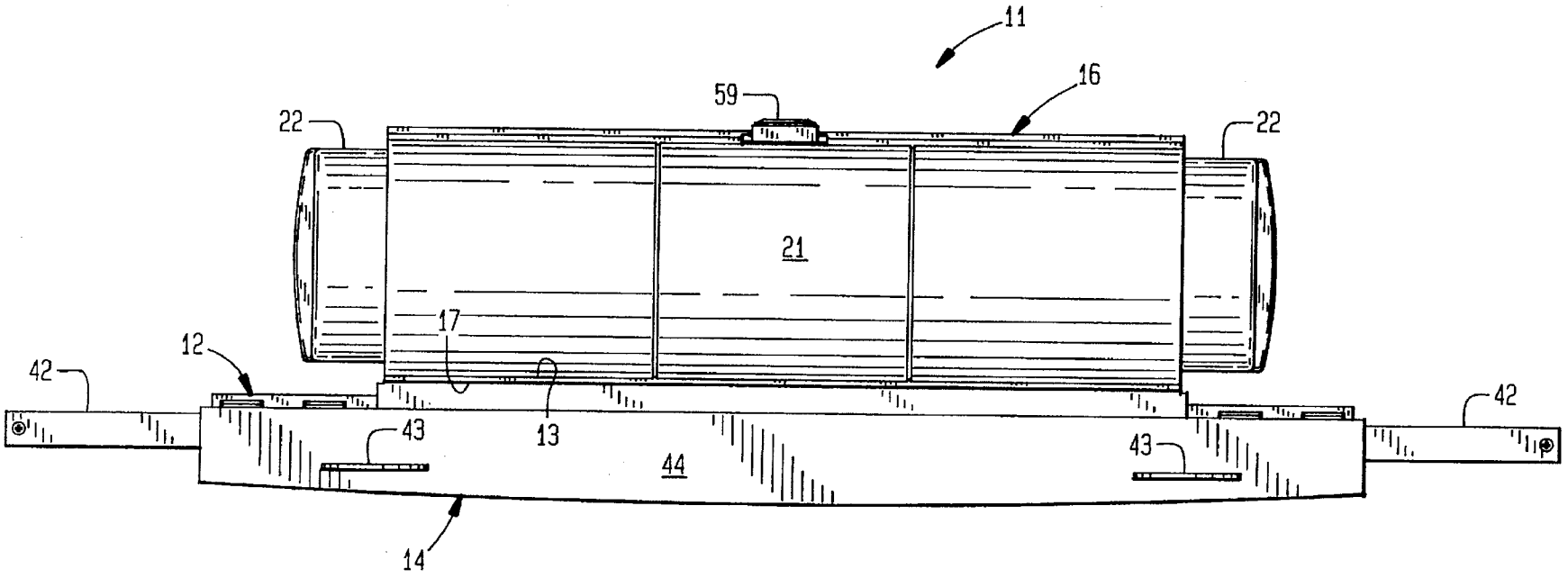
FIG. 4 is a top view of the fan shown in FIGS. 1–3.
Figure 7:
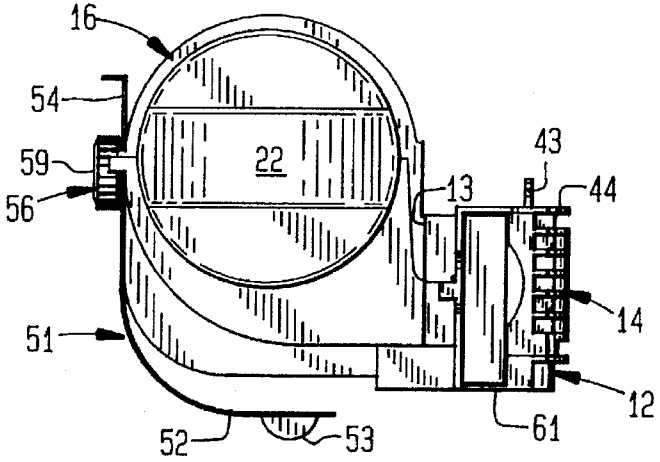
FIG. 7 is a left side elevational view of the fan shown in FIGS. 1–6.

Vertical support for the blower housing 16 is provided with a leg formed by a curved strap 51 most clearly shown in FIGS. 6 and 7. A first terminal portion 52 of the strap 51 retains a support pad 53 while a second upwardly projecting terminal portion 54 is fixed by an adjustment mechanism 56 to an outer portion of the blower housing 16 facing away from the air director housing 12. Forming the adjustment mechanism 56 is an elongated slot 58 defined by the second terminal portion 54 and a fastener screw 59 extending through the slot 58 and threadedly engaged with the blower housing 16 as illustrated in FIG. 3.

Prior to use of the portable fan 11, a bottom wall surface 61 of the air director housing 12 is placed on a sill 62 of a double hung window 63 as shown in FIG. 6. A sash 65 of the window 63 then is moved downwardly into engagement with the top wall 44 and the tabs 43 of the air director housing 12 to retain the fan in place. Additional vertical stability for the fan is provided by the strap leg 51 which is adjusted vertically to establish supportive engagement between the pad 53 on the first terminal portion 52 and a bottom frame portion 67 of the window 63. Adjustment is accomplished by first loosening the screw fastener 59 to allow relative movement between the second terminal portion 54 of the leg 51 and the blower housing 16. After supportive engagement between the pad 53 and the frame 67 is established, the screw fastener 59 is turned into the blower housing 16 to provide frictional retention of the second terminal portion 54. The wing walls 42 then are expanded to engage side frame surfaces (not shown) of the window 63 and thereby close the window opening between the sill 62 and the sash 65.

After placement of the fan 11 in the manner described above, the plug 40 on the power cord 39 is inserted into a suitable power outlet (not shown). Manual actuation of the switch knob 35 then will energize the electric motor 28 to produce rotation of the blower wheels 26, outside air is drawn in through the second openings 18 and discharged centrifically within the blower housing 16. The discharged air is directed by the blower wheels 26 and internal surfaces of the cylindrical blower housing 16 through the first opening 17 thereof and the air flow passage 24 defined by the air director housing 12 before being discharged through the ports 32 into the enclosure (not shown) retaining the window 63. Because of the elongated form of the air director housing 12 and the horizontal and vertical projection therefrom of the cylindrical blower housing 16, the air director housing 12 is accommodated by a relatively small opening between the sill 62 and the sash 65 and the blower housing 16 is disposed primarily behind the sash 65. Thus, the fan 11 does not reduce significantly the level of light transmission and scope of view provided by the window 63.

Obviously, many modifications and variations of the present invention are possible in light of the above teachings. It is to be understood, therefore, that the invention can be practiced otherwise than as specifically described.

What is claimed is:

1. A portable fan comprising:

air director housing means elongated on a horizontal axis and adapted for mounting between a sill and sash of an open window and having oppositely directed first and second open ends for accommodating air flow, spaced apart top and bottom walls extending between said first and second open ends, and spaced apart side walls joined to said top and bottom walls and extending between said first and second open ends; said side walls and said top and bottom walls defining an air flow passage between said first and second open ends and extending transverse to said horizontal axis;

blower housing means elongated in a direction parallel to said horizontal axis and joined to said first open end of said air director housing means and defining first and second opening means for accommodating air flow; said blower housing means projecting from said air director housing means for a substantial first horizontally directed distance d and for a substantial second vertically directed distance D, and said first opening means communicating with said first open end;

blower means retained in said blower housing means and operable to produce air flow between said first and second opening means and through said air flow passage;

motor means retained in said blower housing means and operatively coupled to said blower means;

a wing wall projecting from at least one of said side walls and movable relative thereto;

leg means projecting downwardly from said blower housing means and adapted to engage a bottom frame portion of the window, said leg means projecting a predetermined distance below said bottom wall of said air director housing means; and adjustment means for adjusting said predetermined distance; and wherein said leg means comprises a curved strip having a first terminal portion for engaging the frame portion of the window and a second terminal portion fixed to an outer portion of said blower housing means facing away from said air director housing means, and said adjustment means comprises connection means allowing relative movement between said blower housing means and said second terminal portion.

2. A fan according to claim 1 wherein said air director housing means has an elongated length l at least five times its height h and said air flow passage has a given length s less than either said first distance d or said second distance D.

3. A fan according to claim 2 wherein said second distance is directed vertically upwardly from said air director housing means.

4. A fan according to claim 3 wherein said blower means comprises a squirrel cage blower wheel.

5. A fan according to claim 3 wherein said blower means comprises a pair of blower wheels spaced apart in said direction parallel to said horizontal axis, and said motor means comprises an electric motor straddled by said blower wheels and operatively coupled thereto.

6. A fan according to claim 5 wherein said blower housing means is substantially cylindrical.

7. A fan according to claim 6 wherein said second opening means comprises a plurality of separate openings spaced apart in said direction parallel to said horizontal axis, at least one of said separate openings being disposed adjacent to each end of each of said blower wheels.

8. A fan according to claim 7 wherein each of said separate openings is directed only in a substantially downward direction.

9. A fan according to claim 8 wherein said blower housing further defines a screen covering each of said separate openings and substantially impermeable to insects.

10. A fan according to claim 9 wherein said blower housing comprises a central portion retaining said blower wheels and said electric motor and an end portion removably attached to each opposite end thereof, each of said end portions defining one of said separate openings.

11. A fan according to claim 10 wherein said second open end defines a pair of spaced apart ports separated by an electric control panel and each aligned with a different one of said blower wheels.

12. A fan according to claim 1 wherein said connection means comprises an elongated slot in said second terminal portion and a fastener received by said slot and engaged with said blower housing means and adjustable so as to prevent said relative movement.

13. A portable fan comprising:

air director housing means having a bottom wall for mounting on a sill of an open window and having open first and second open ends for accommodating air flow, said air director housing defining an air flow passage between said first and second open ends;

blower housing means joined to said first open end of said air director housing means and defining first and second opening means for accommodating air flow; said blower housing means projecting a substantial distance from said first open end;

blower means retained in said blower housing means and operable to produce air flow between said first and second opening means and through said air flow passage;

motor means retained in said blower housing means and operatively coupled to said blower means;

leg means projecting downwardly from said blower housing means a predetermined distance below said bottom wall of said air director housing means; said leg means comprising a curved strip having a first terminal portion for engaging the frame portion of the window and a second terminal portion fixed to an outer portion of said blower housing means facing away from said air director housing means; and connection means allowing relative movement between said blower housing means and said second terminal portion so as to allow adjustment of said predetermined distance.

14. A fan according to claim 13 wherein said connection means comprises an elongated slot in said second terminal portion and a fastener received by said slot and engaged with said blower housing means and adjustable so as to prevent said relative movement.

* * * * *